US012745881B2

(12) United States Patent
Ren et al.

(10) Patent No.: US 12,745,881 B2
(45) Date of Patent: Sep. 29, 2026

(54) QUICK RELEASE STRUCTURE FOR TOILET LID

(71) Applicant: Xiamen Beewill Sanitary Co., Ltd., Xiamen (CN)

(72) Inventors: Shisong Ren, Xiamen (CN); Xiong Yang, Xiamen (CN)

(73) Assignee: Xiamen Beewill Sanitary Co., Ltd., Xiamen (CN)

( * ) Notice: Subject to any disclaimer, the term of this patent is extended or adjusted under 35 U.S.C. 154(b) by 164 days.

(21) Appl. No.: 18/772,108

(22) Filed: Jul. 13, 2024

(65) Prior Publication Data

US 2024/0374090 A1 Nov. 14, 2024

(30) Foreign Application Priority Data

Feb. 1, 2024 (CN) ..... 202420254114.8

(51) Int. Cl.
*A47K 13/26* (2006.01)

(52) U.S. Cl.
CPC ..... *A47K 13/26* (2013.01)

(58) Field of Classification Search
CPC ..... A47K 13/26; A47K 13/10
See application file for complete search history.

(56) References Cited

U.S. PATENT DOCUMENTS

| | | | | |
|---|---|---|---|---|
| 4,914,757 | A | 4/1990 | Johnson | |
| 2015/0230674 | A1 | 8/2015 | Falk | |
| 2021/0113035 | A1* | 4/2021 | Hand | A47K 13/12 |
| 2024/0188769 | A1* | 6/2024 | Yang | A47K 13/06 |

FOREIGN PATENT DOCUMENTS

| | | | |
|---|---|---|---|
| CN | 202198531 U | | 4/2012 |
| CN | 207734097 U | * | 8/2018 |

OTHER PUBLICATIONS

Translation CN-207734097-U (Year: 2026).*

* cited by examiner

*Primary Examiner* — Janie M Loeppke

(57) ABSTRACT

The utility model provides a quick release structure for a toilet lid, including: a movement cover, a linkage shaft, a slide switch, a rotating shaft and a protective cover, wherein the movement cover defines an insertion hole and an avoidance slot; the linkage shaft is provided with a clamping slot, and the linkage shaft is adapted to be inserted into the insertion hole; the rotating shaft is provided with a connection portion, the connection portion is adapted to be clamped into the clamping slot through the avoidance slot, and the rotating shaft can drive the linkage shaft to synchronously rotate when the connection portion is clamped into the clamping slot; the slide switch is slidably mounted in the avoidance slot to expose the clamping slot or cover the clamping slot; and the protective cover can expose the slide switch or shield the slide switch.

9 Claims, 9 Drawing Sheets

QUICK RELEASE STRUCTURE FOR TOILET LID

CROSS-REFERENCE TO RELATED APPLICATIONS

This application claims the benefit of priority from Chinese Patent Application No. 202420254114.8, filed on Feb. 1, 2024. The content of the aforementioned application, including any intervening amendments thereto, is incorporated herein by reference in its entirety.

TECHNICAL FIELD OF THE INVENTION

The utility model relates to the technical field of bathrooms, in particular to a quick release structure for a toilet lid.

BACKGROUND OF THE INVENTION

Toilets are widely used in various occasions in daily life and are one of indispensable sanitary wares in people's lives. Toilet lids are an important part of the toilets and need to be removed for maintenance or cleaning operations during actual use in order to facilitate maintenance or cleaning.

In the related art, quick disassembly of a toilet lid is achieved by a quick release structure, but the structure is complicated and a protection device is lacked, a quick disassembly button or a quick disassembly switch is easily touched during use, causing the toilet lid to be detached from the connection of the quick release structure, and there are potential safety hazards during use.

SUMMARY OF THE INVENTION

The utility model aims to solve at least one of the technical problems in the above technology to some extent. To this end, an object of the utility model is to provide a quick release structure for a toilet lid, which can quickly dismount or mount the toilet lid, is simple to operate, and can prevent mistaken touch, and ensure safe use.

In order to achieve the above object, the utility model provides a quick release structure for a toilet lid, including: a movement cover, a linkage shaft, a rotating shaft, a slide switch and a protective cover, wherein

- the movement cover defines an insertion hole and an avoidance slot;
- the linkage shaft is provided with a clamping slot, and the linkage shaft is adapted to be inserted into the insertion hole;
- the rotating shaft is provided with a connection portion, the connection portion is adapted to be clamped into the clamping slot through the avoidance slot, and the rotating shaft can drive the linkage shaft to synchronously rotate when the connection portion is clamped into the clamping slot;
- the slide switch is mounted in the avoidance slot, the slide switch is slidably disposed between a first position and a second position, the slide switch exposes the clamping slot to allow the connection portion to be clamped into or detached from the clamping slot in the first position, and the slide switch covers the clamping slot to allow the connection portion to be kept in the clamping slot in the second position; and
- the protective cover is switchably disposed in a locked state and an unlocked state, in the unlocked state, the protective cover exposes the slide switch, in the locked state, the protective cover shields the slide switch, and the protective cover abuts against the slide switch to slide the slide switch from the first position to the second position.

According to the quick release structure for a toilet lid proposed by the utility model, the protective cover exposes the slide switch in the unlocked state, the slide switch slides to the first position to expose the clamping slot of the linkage shaft so that the connection portion of the rotating shaft can be clamped into or detached from the clamping slot, the protective cover abuts against the slide switch in the locked state to slide the slide switch from the first position to the second position so that the slide switch covers the clamping slot to allow the connection portion to be kept in the clamping slot. The quick release structure for the toilet lid can quickly dismount or mount the toilet lid, is simple to operate, and can prevent mistaken touch, and ensure safe use.

In addition, the quick release structure for a toilet lid proposed according to the above embodiment of the utility model may also have the following additional technical features:

- optionally, the slide switch is provided with a snap, the movement cover is provided with a first slotted hole and a second slotted hole, the snap is clamped into the first slotted hole when the slide switch is in the first position, and the snap is clamped into the second slotted hole when the slide switch is in the second position.

Further, the protective cover is provided with an abutting member, and the abutting member abuts against the snap from the first slotted hole to allow the snap to be detached from the first slotted hole when the protective cover is in the locked state.

Further, the slide switch is provided with a pressing portion disposed at an opposite end of the snap, and the pressing portion is adapted to be pressed to allow the snap to be detached from the second slotted hole and clamped into the first slotted hole.

Further, the quick release structure for a toilet lid further includes an elastic member, wherein one end of the elastic member abuts against the pressing portion, and the other end of the elastic member abuts against the movement cover.

Further, when the protective cover is in the locked state, the protective cover and the movement cover together define a pressing space for accommodating the pressing portion, the pressing portion being located in the pressing space.

Optionally, the quick release structure for a toilet lid further includes a fixed sleeve, wherein the fixed sleeve is mounted in a cavity of the movement cover, the insertion hole and the avoidance slot are disposed in the fixed sleeve, an outer peripheral surface of the fixed sleeve is provided with a projection, the cavity is provided with a groove, and the projection is adapted to be matched with the groove to limit a mounting angle of the fixed sleeve.

Optionally, the quick release structure for a toilet lid further includes a damper connected to the linkage shaft at an opposite end of the clamping slot.

Further, the linkage shaft includes an insertion part and a fixed part which are connected to each other, the insertion part is provided with the clamping slot, the fixed part is limited outside the insertion hole, and the fixed part is connected to the damper.

Optionally, the protective cover is hinged to the movement cover or detachably snapped to the movement cover.

Figure 1:
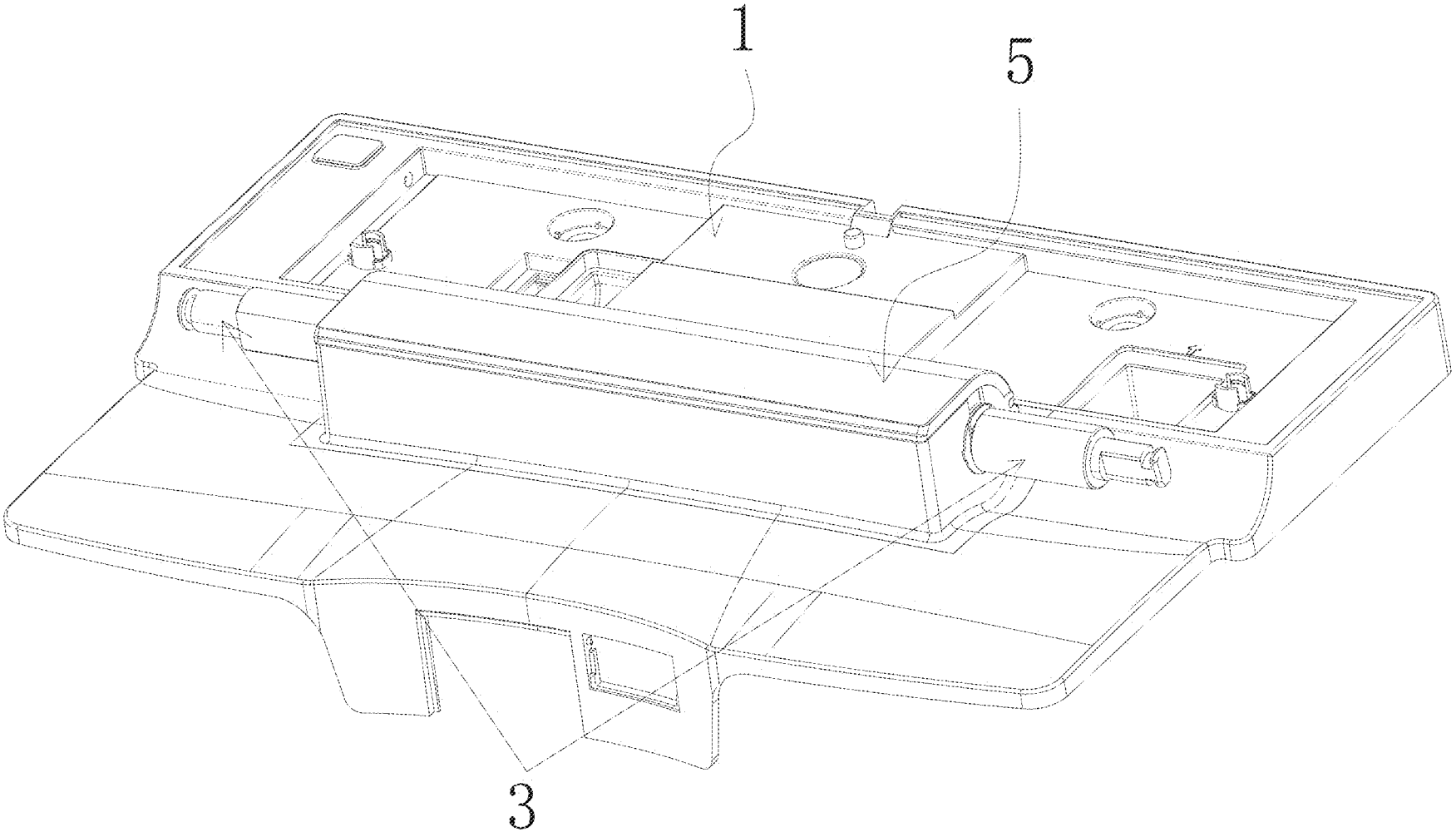
FIG. 1 is a structural schematic diagram of a quick release structure for a toilet lid according to an embodiment of the utility model.

DESCRIPTION OF REFERENCE NUMERALS movement cover 1, insertion hole 11, avoidance slot 12, first slotted hole 13, second slotted hole 14, cavity 15, fixed sleeve 16, projection 161, linkage shaft 2, clamping slot 21, insertion part 22, fixed part 23, rotating shaft 3, connection portion 31, slide switch 4, snap 41, pressing portion 42, protective cover 5, abutting member 51, elastic member 6, damper 7, and magnetic suction member 8.

DETAILED DESCRIPTION OF THE INVENTION

The embodiments of the utility model are described in detail below, and the examples of the embodiments are shown in the accompanying drawings, wherein throughout the same or similar reference numerals indicate the same or similar elements or elements having the same or similar function. The embodiments described below by referring to the accompanying drawings are exemplary, and are intended to be used for explaining the utility model, and cannot be understood as a limitation on the utility model.

In order to better understand the above technical solutions, exemplary embodiments of the utility model will be described in more detail below with reference to the accompanying drawings. Although the exemplary embodiments of the utility model are shown in the accompanying drawings, it should be understood that the utility model may be implemented in various forms and should not be limited by the embodiments set forth herein. On the contrary, these embodiments are provided to more thoroughly understand the utility model, and fully convey the scope of the utility model to those skilled in the art.

For a better understanding of the above technical solutions, the above technical solutions will be described in detail below in conjunction with the drawings and the specific embodiments.

Figure 2:
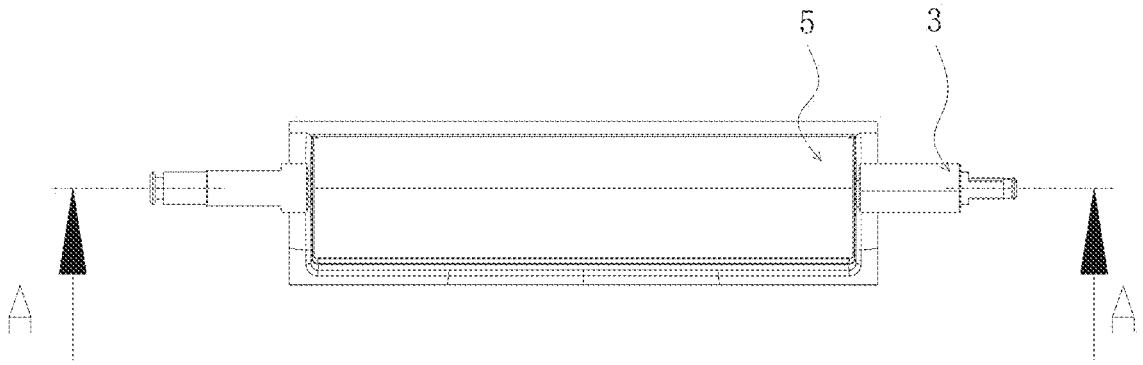
FIG. 2 is a partial structural schematic diagram of the quick release structure for a toilet lid according to the embodiment of the utility model.
Figure 3:
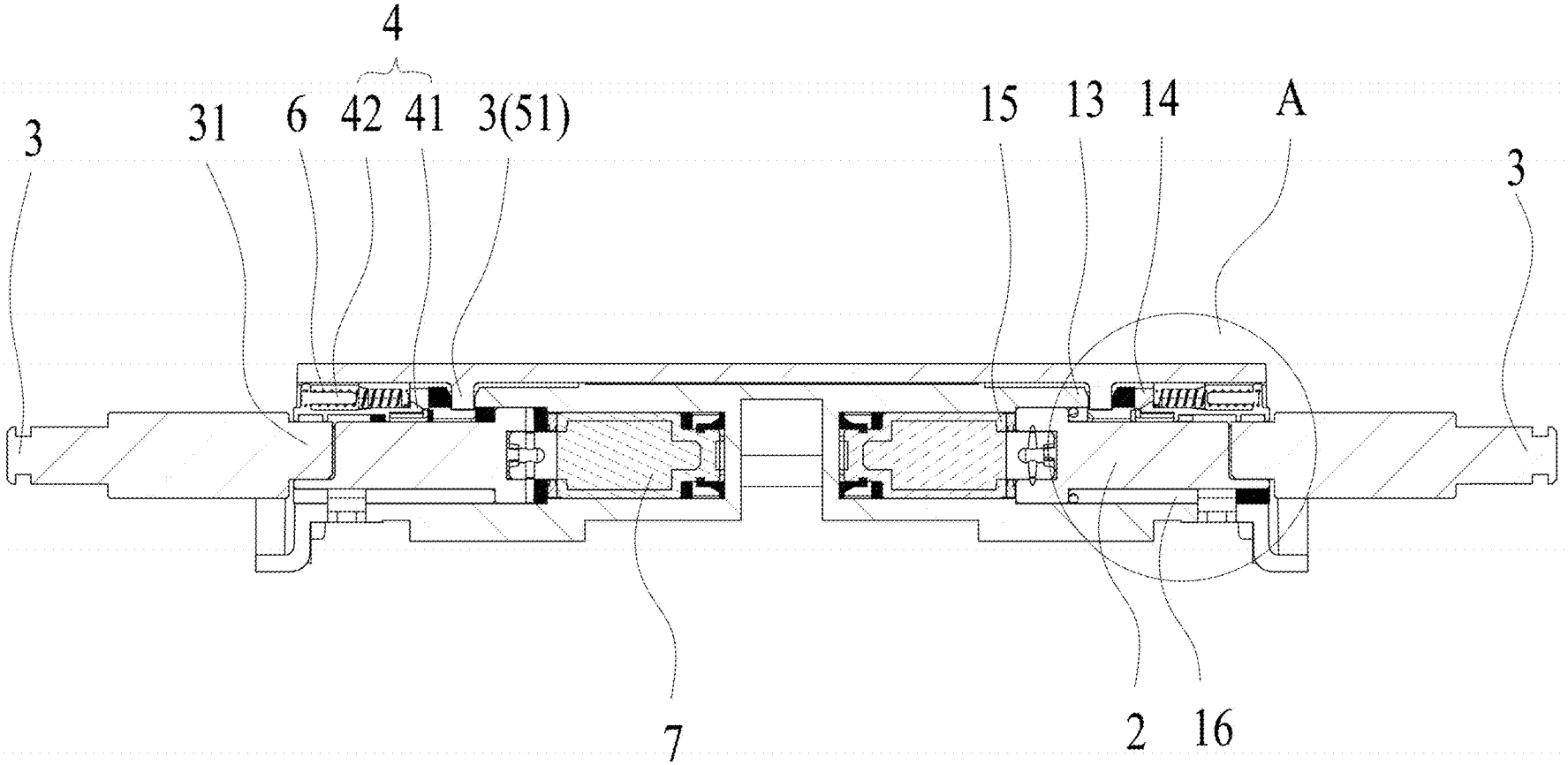
FIG. 3 is a cross-sectional view along A-A of FIG. 2.
Figure 4:
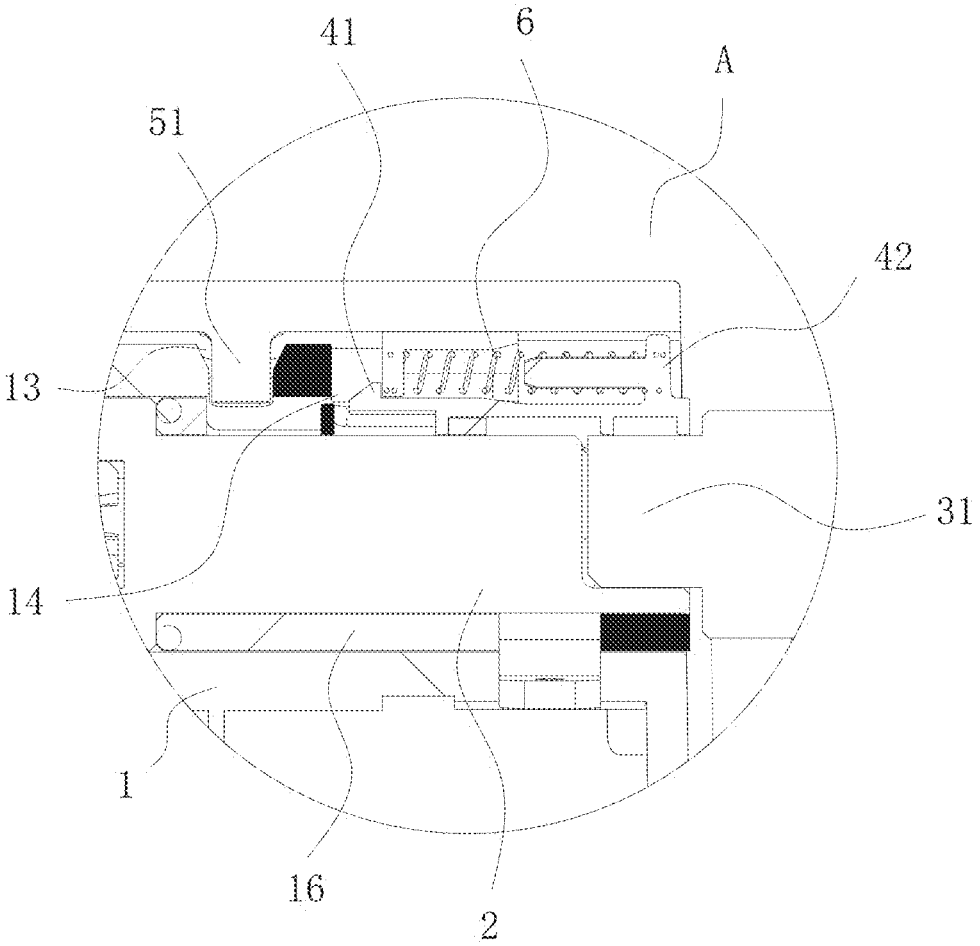
FIG. 4 is an enlarged view at A of FIG. 3.
Figure 5:
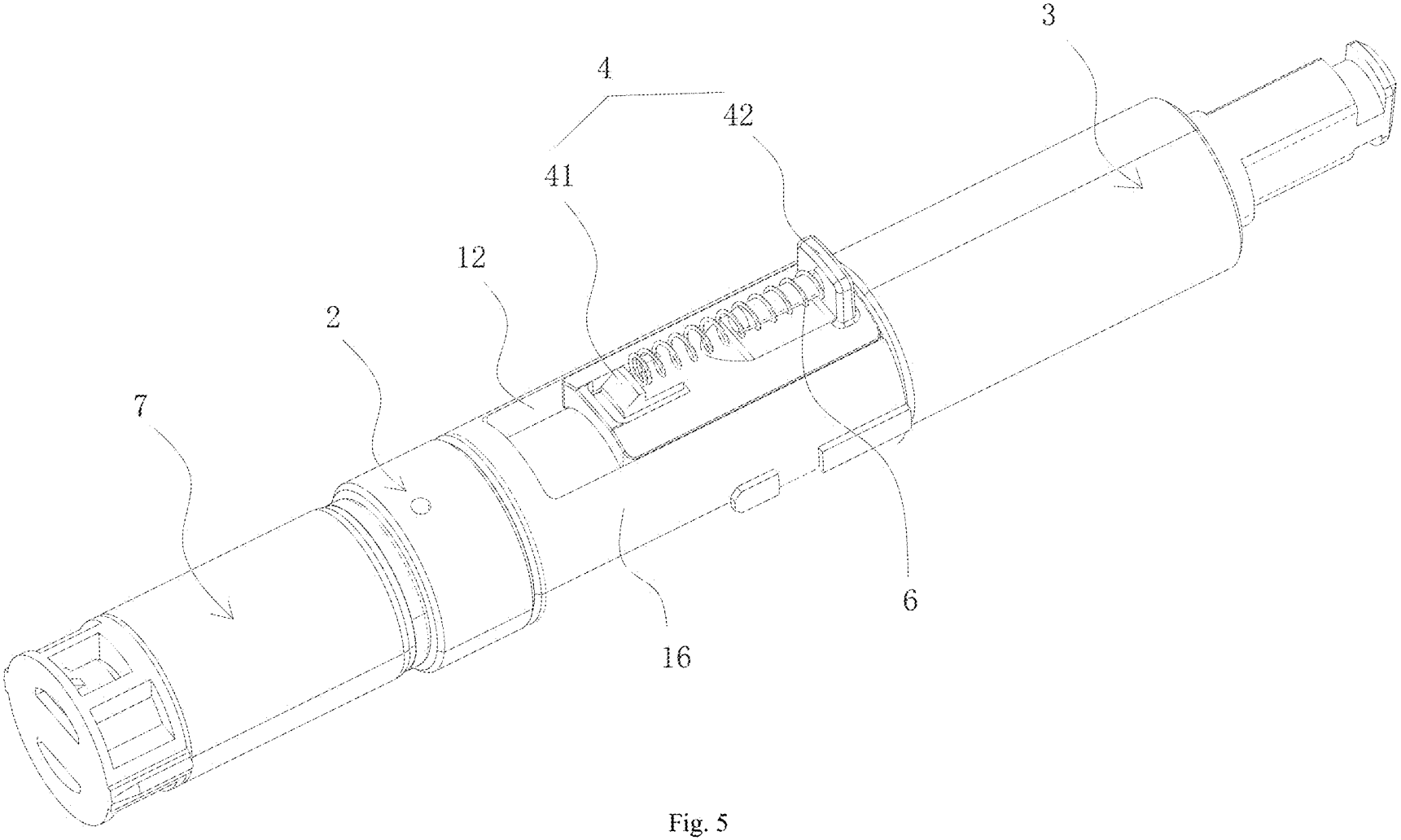
FIG. 5 is a structural schematic diagram of a connection assembly according to an embodiment of the utility model.
Figure 6:
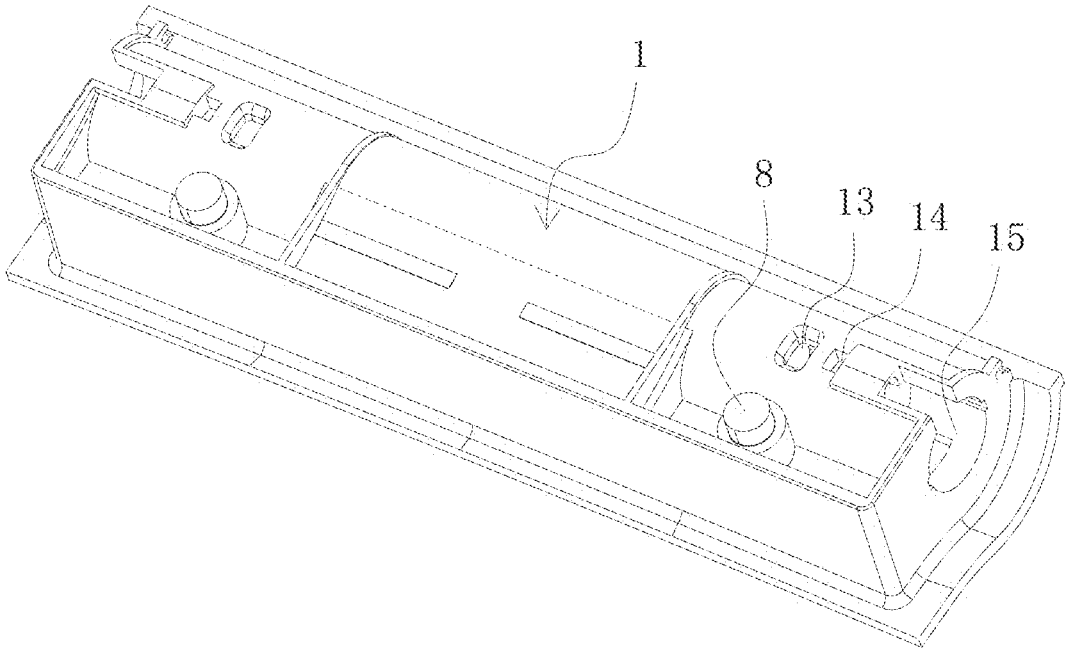
FIG. 6 is a partial structural schematic diagram of a movement cover according to an embodiment of the utility model.
Figure 7:
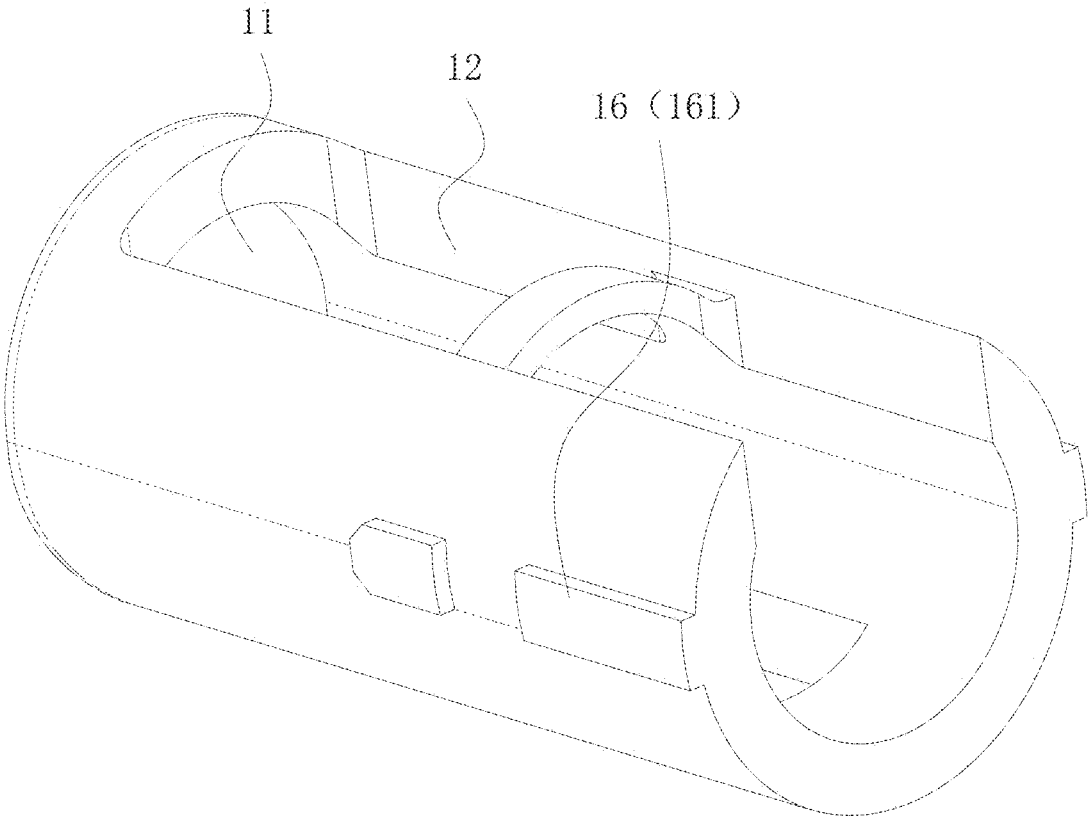
FIG. 7 is a structural schematic diagram of a fixed sleeve according to an embodiment of the utility model.
Figure 8:
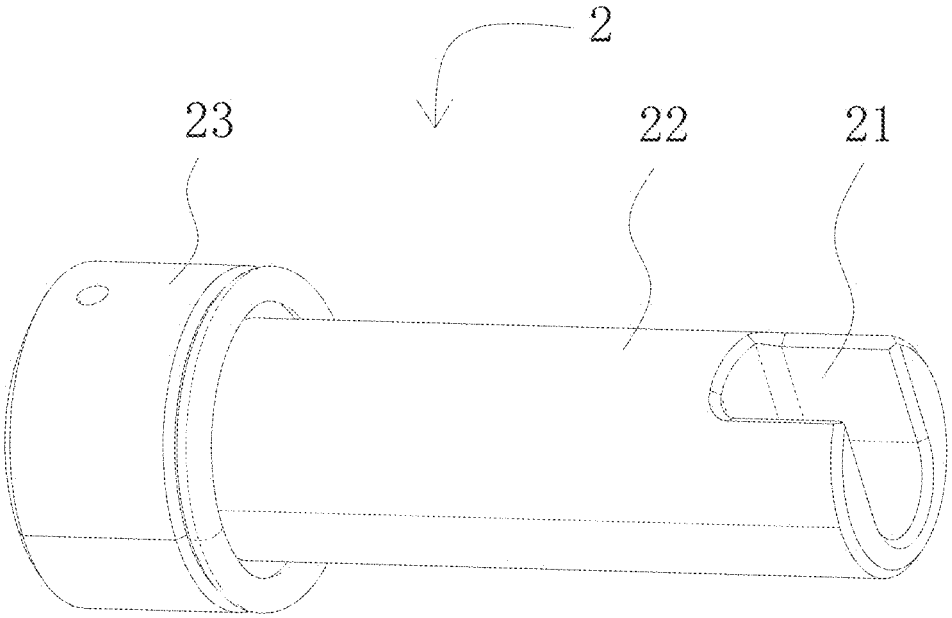
FIG. 8 is a structural schematic diagram of a linkage shaft according to an embodiment of the utility model.
Figure 9:
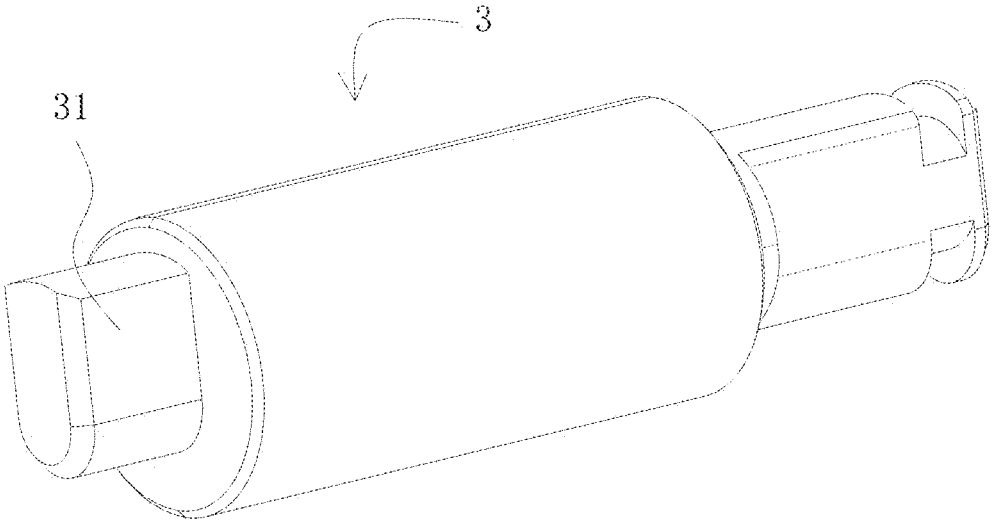
FIG. 9 is a structural schematic diagram of a rotating shaft according to an embodiment of the utility model.

The implementation of a quick release structure for a toilet lid according to an embodiment of the utility model will be described below in detail with reference to FIGS. 1 to 9.

The quick release structure for a toilet lid according to the embodiment of the utility model includes: a movement cover 1, a linkage shaft 2, a rotating shaft 3, a slide switch 4 and a protective cover 5.

In particular, the movement cover 1 defines an insertion hole 11 and an avoidance slot 12; the linkage shaft 2 is provided with a clamping slot 21, and the linkage shaft 2 is adapted to be inserted into the insertion hole 11; the rotating shaft 3 is provided with a connection portion 31, the connection portion 31 is adapted to be clamped into the clamping slot 21 through the avoidance slot 12, and the rotating shaft 3 can drive the linkage shaft 2 to synchronously rotate when the connection portion 31 is clamped into the clamping slot 21; the slide switch 4 is mounted in the avoidance slot 12, the slide switch 4 is slidably disposed between a first position and a second position, the slide switch 4 exposes the clamping slot 21 to allow the connection portion 31 to be clamped into or detached from the clamping slot 21 in the first position, and the slide switch 4 covers the clamping slot 21 to allow the connection portion 31 to be kept in the clamping slot 21 in the second position; and the protective cover 5 is switchably disposed in a locked state and an unlocked state, in the unlocked state, the protective cover 5 exposes the slide switch 4, in the locked state, the protective cover 5 shields the slide switch 4, and the protective cover 5 abuts against the slide switch 4 to slide the slide switch 4 from the first position to the second position.

That is, rotation of the linkage shaft 2 in the insertion hole 11 is facilitated by insertion of the linkage shaft 2 into the insertion hole 11 of the movement cover 1, the connection portion 31 of the rotating shaft 3 is adapted to be connected with the clamping slot 21 of the linkage shaft 2, an opposite end of the connection portion 31 of the rotating shaft 3 is connected with the toilet lid, when the toilet lid is turned over, the rotating shaft 3 can drive the linkage shaft 2 to synchronously rotate, thereby rotating the clamping slot 21 of the linkage shaft 2 by an angle, when the toilet lid needs to be disassembled, the protective cover 5 is in an unlocked state, and the slide switch 4 is exposed, facilitating triggering of the slide switch 4 to slide the slide switch 4 from the second position to the first position, the toilet lid is cooperated to be turned over such that the avoidance slot 12 communicates with the clamping slot 21 of the linkage shaft 2 to facilitate detachment of the connection portion 31 of the rotating shaft 3 from the clamping slot 21, when the toilet lid needs to be mounted, the connection portion 31 of the rotating shaft 3 is clamped into the clamping slot 21 through the avoidance slot 12, when the protective cover 5 is in a locked state again, the protective cover 5 abuts against the slide switch 4, so that the slide switch 4 slides from the first position to the second position, the slide switch 4 covers the clamping slot 21, so that the connection portion 31 of the rotating shaft 3 is kept in the clamping slot 21, thereby realizing quick installation of the toilet lid, while the protective cover 5 shields the slide switch 4, preventing the slide switch 4 from being touched by mistake.

Whereby, the protective cover 5 exposes the slide switch 4 in the unlocked state, by sliding the slide switch 4 to the first position, the clamping slot 21 of the linkage shaft 2 is exposed so that the connection portion 31 of the rotating shaft 3 can be clamped into or detached from the clamping slot 21, and the protective cover 5 abuts against the slide switch 4 in the locked state to slide the slide switch 4 from the first position to the second position so that the slide switch 4 covers the clamping slot 21 to allow the connection portion 31 to be kept in the clamping slot 21. The quick release structure for the toilet lid can quickly dismount or mount the toilet lid, is simple to operate, and can prevent mistaken touch, and ensure safe use.

For the retention of the slide switch 4 in the first position and the second position, the slide switch 4 is provided with a snap 41, the movement cover 1 is provided with a first slotted hole 13 and a second slotted hole 14, the snap 41 is clamped into the first slotted hole 13 when the slide switch 4 is in the first position, and the snap 41 is clamped into the second slotted hole 14 when the slide switch 4 is in the second position. It can be understood that by the provision of the snap 41 of the slide switch 4, the snap 41 can be facilitated to be clamped into the first slotted hole 13 or the second slotted hole 14, thereby facilitating the retention of the slide switch 4 in the first position or the second position. The first slotted hole 13 and the second slotted hole 14 may be through holes disposed in a cavity 15.

For the protective cover 5, the protective cover 5 is provided with an abutting member 51 that abuts against the snap 41 from the first slotted hole 13 to allow the snap 41 to be detached from the first slotted hole 13 when the protective cover 5 is in the locked state. It can be understood that the abutting member 51 abuts against the snap 41 from the first slotted hole 13 so that the snap 41 is detached from clamping into the first slotted hole 13, thereby facilitating sliding of the slide switch from the first position to the second position. The abutting member 51 may be disposed in the shape of a projection 161, the abutting member 51 may be integrally formed on the protective cover 5, and when the abutting member 51 abuts against the snap 41, the snap 41 is elastically deformed to be detached from the first slotted hole 13.

For the triggering of the slide switch 4, the slide switch 4 is provided with a pressing portion 42 disposed at an opposite end of the snap 41, and the pressing portion 42 is adapted to be pressed to allow the snap 41 to be detached from the second slotted hole 14 and clamped into the first slotted hole 13. It can be understood that by the provision of the pressing portion 42, it is possible to facilitate manual pressing of the pressing portion 42 so as to allow the snap 41 to be detached from the second slotted hole 14 and clamped into the first slotted hole 13, thereby facilitating the sliding of the slide switch 4 from the second position to the first position. The pressing portion 42 may be disposed in a square shape perpendicular to a sliding direction, and the pressing portion 42 may be integrally formed in the slide switch 4.

For sliding the slide switch 4 from the first position to the second position, an elastic member 6 is also included, one end of the elastic member 6 abuts against the pressing portion 42 and the other end of the elastic member 6 abuts against the movement cover 1. It can be understood that the elastic member 6 is provided so that the slide switch 4 is subjected to an elastic force towards the second position, when the abutting member 51 of the protective cover 5 abuts against the snap 41 from the first slotted hole 13, the snap 41 is detached from the first slotted hole 13, and the elastic member 6 pushes the slide switch 4 towards the second slotted hole 14, thereby causing the snap 41 to be clamped into the second slotted hole 14. The elastic member 6 may be a spring.

For the protection of the slide switch 4, when the protective cover 5 is in the locked state, the protective cover 5 and the movement cover 1 together define a pressing space for accommodating the pressing portion 42, the pressing portion 42 being located in the pressing space. It can be understood that by disposing the pressing space, it is possible to facilitate the pressing portion 42 to be hidden in the pressing space, thereby preventing the pressing portion 42 from being touched by mistake to cause a risk that the toilet lid is disconnected, and also to make the pressing portion 42 visible, thereby facilitating the finding of the pressing portion 42.

Optionally, a fixed sleeve 16 is further included, and the fixed sleeve 16 is mounted in the cavity 15 of the movement cover 1, the insertion hole 11 and the avoidance slot 12 are disposed in the fixed sleeve 16, an outer peripheral surface of the fixed sleeve 16 is provided with a projection 161, the cavity 15 is provided with a groove, and the projection 161 is adapted to be matched with the groove to limit a mounting angle of the fixed sleeve 16. It can be understood that the fixed sleeve 16 is provided to facilitate the insertion of the linkage shaft 2 into the insertion hole 11, and the fixed sleeve 16 is mounted in the cavity 15 of the movement cover 1, thereby reducing the difficulty of mounting the linkage shaft 2 and improving the mounting efficiency; and the angle of rotation of the fixed sleeve 16 is limited by the cooperation of the projection 161 with the groove, thereby facilitating the fixed sleeve 16 to be mounted in the cavity 15 at a correct angle, thereby facilitating the angular limitation of the avoidance slot 12.

For the damping of the toilet lid, a damper 7 is also included, and the damper 7 is connected to the linkage shaft 2 at an opposite end of the clamping slot 21. It can be understood that by the provision of the damper 7, the toilet lid has a damping effect when being turned over, increasing the resistance of turning the toilet lid over, and reducing the noise during collision. The damper 7 may adopt the existing structure.

For the linkage shaft 2, the linkage shaft 2 includes an insertion part 22 and a fixed part 23 which are connected to each other, the insertion part 22 is provided with the clamping slot 21, the fixed part 23 is limited outside the insertion hole 11, and the fixed part 23 is connected to the damper 7. It can be understood that the fixed sleeve 16 can be facilitated to be cooperated by the insertion part 22 so that the linkage shaft 2 is rotatably mounted in the insertion hole 11 of the fixed sleeve 16, and the damper 7 can be facilitated to be connected by the fixed part 23 so that the toilet lid has a damping effect when being turned over.

For the mounting of the protective cover 5, the protective cover 5 is hinged to the movement cover 1 or detachably snapped to the movement cover 1.

Embodiment 1

The protective cover 5 is hinged to the movement cover 1. It can be understood that the turning of the protective cover 5 can be facilitated by allowing the protective cover 5 to be hinged to the movement cover 1, such that the abutting member 51 is close to and abuts against the slide switch 4 when the protective cover 5 is covered, or the pressing portion 42 of the slide switch 4 can be facilitated to be manually pressed when the protective cover 5 is open. One side of the protective cover 5 may be integrally formed with a connection shaft that is clamped into the clamping slot of the movement cover 1, and the other side of the protective cover 5 may cooperate to be connected to the movement cover by a magnetic suction member 8.

Embodiment 2

The protective cover 5 is detachably snapped to the movement cover 1. It can be understood that the protective cover 5 is detachably connected to the movement cover 1 to facilitate quick mounting of the protective cover 5 on the movement cover 1 or quick disassembly of the protective cover 5 from the movement cover 1, and when the protective cover 5 is mounted on the movement cover 1, the abutting member 51 is close to and abuts against the snap 41 of the slide switch 4, and when the protective cover 5 is dismounted, manual pressing of the pressing portion 42 of the slide switch 4 is facilitated. The protective cover 5 may also be clamped to the movement cover 1, and may also cooperate to be connected to the movement cover 1 by a magnetic suction member 8.

In the description of the utility model, it needs to be understood that the terms "central," "longitudinal," "lateral," "length," "width," "thickness," "upper," "lower," "front," "rear," "left," "right," "vertical," "horizontal," "top," "bottom," "inner," "outer," "clockwise," "counterclockwise," and the like indicate an orientation or positional relationship based on the orientation or positional relationship shown in the drawings, are merely for ease of description of the utility model and simplification of the description, and are not intended to indicate or imply that the device or element referred to must have a particular orientation, and be constructed and operate in a particular orientation, and therefore should not be construed as a limitation of the utility model.

Furthermore, the terms "first" and "second" are used for descriptive purposes only and cannot be understood to indicate or imply relative importance or to implicitly specify the number of technical features indicated. Thus, features defined with "first" and "second" may explicitly or implicitly include one or more of such features. In the description of the utility model, "a plurality of" means two or more, unless expressly and specifically defined otherwise.

In the utility model, unless expressly specified and limited otherwise, the terms "mounted", "connected", "connection", "fixed" and the like should be understood in a broad sense, e.g., it can be fixed connection or detachable connection, or integral formation; it can be mechanical connection or electrical connection; it can be may be direct connection or indirect connection through an intermediate medium, and it can be internal communication between two elements or an interaction relationship between two elements. The specific meaning of the above terms in the utility model can be understood by those of ordinary skill in the art based on specific circumstances.

In the utility model, unless expressly specified and limited otherwise, a first feature "above" or "below" a second feature may include that the first and second features are in direct contact or that the first and second features are not in direct contact but are in contact through another feature between the first and second features. Moreover, a first feature is "over," "above," and "on" a second feature, which includes that the first feature is directly above and obliquely above the second feature, or simply indicates that the first feature is at a level higher than the second feature. A first feature is "beneath," "below," and "under" a second feature, which includes the first feature is directly below and obliquely below the second feature, or simply indicates that the first feature is at a level less than the second feature.

In the description of this specification, the description of the reference terms "one embodiment", "some embodiments", "an example", "a specific example", "some examples", and the like means that particular features, structures, materials, or characteristics described in connection with the embodiment or example are included in at least one embodiment or example of the utility model. In this specification, illustrative expressions of the above terms should not be understood as necessarily referring to the same embodiment or example. Furthermore, the particular features, structures, materials, or characteristics described may be combined in a suitable manner in any one or more embodiments or examples. In addition, different embodiments or examples described in this specification may be joined and combined by those skilled in the art.

Although the embodiments of the utility model have been shown and described above, it can be understood that the above embodiments are exemplary and cannot be construed as a limitation of the utility model, and that those of ordinary skill in the art may make changes, modifications, substitutions, and variations to the above embodiments within the scope of the utility model.

What is claimed is:

1. A quick release structure for a toilet lid, comprising: a movement cover, a linkage shaft, a rotating shaft, a slide switch and a protective cover, wherein the movement cover defines an insertion hole and an avoidance slot;

the linkage shaft is provided with a clamping slot, and the linkage shaft is adapted to be inserted into the insertion hole;

the rotating shaft is provided with a connection portion, the connection portion is adapted to be clamped into the clamping slot through the avoidance slot, and the rotating shaft can drive the linkage shaft to synchronously rotate when the connection portion is clamped into the clamping slot;

the slide switch is mounted in the avoidance slot, the slide switch is slidably disposed between a first position and a second position, the slide switch exposes the clamping slot to allow the connection portion to be clamped into or detached from the clamping slot in the first position, and the slide switch covers the clamping slot to allow the connection portion to be kept in the clamping slot in the second position;

the protective cover is switchably disposed in a locked state and an unlocked state, in the unlocked state, the protective cover exposes the slide switch, in the locked state, the protective cover shields the slide switch, and the protective cover abuts against the slide switch to slide the slide switch from the first position to the second position; and the slide switch is provided with a snap, the movement cover is provided with a first slotted hole and a second slotted hole, the snap is clamped into the first slotted hole when the slide switch is in the first position, and the snap is clamped into the second slotted hole when the slide switch is in the second position.

2. The quick release structure for a toilet lid according to claim 1, wherein the protective cover is provided with an abutting member, and the abutting member abuts against the snap from the first slotted hole to allow the snap to be detached from the first slotted hole when the protective cover is in the locked state.

3. The quick release structure for a toilet lid according to claim 1, wherein the slide switch is provided with a pressing portion disposed at an opposite end of the snap, and the pressing portion is adapted to be pressed to allow the snap to be detached from the second slotted hole and clamped into the first slotted hole.

4. The quick release structure for a toilet lid according to claim 3, further comprising an elastic member, wherein one end of the elastic member abuts against the pressing portion, and the other end of the elastic member abuts against the movement cover.

5. The quick release structure for a toilet lid according to claim 3, wherein when the protective cover is in the locked state, the protective cover and the movement cover together define a pressing space for accommodating the pressing portion, the pressing portion being located in the pressing space.

6. The quick release structure for a toilet lid according to claim 1, further comprising a damper connected to the linkage shaft at an opposite end of the clamping slot.

7. The quick release structure for a toilet lid according to claim 6, wherein the linkage shaft comprises an insertion part and a fixed part which are connected to each other, the insertion part is provided with the clamping slot, the fixed part is limited outside the insertion hole, and the fixed part is connected to the damper.

8. The quick release structure for a toilet lid according to claim 1, wherein the protective cover is hinged to the movement cover or detachably snapped to the movement cover.

9. A quick release structure for a toilet lid, comprising: a movement cover, a linkage shaft, a rotating shaft, a slide switch, a protective cover and a fixed sleeve;

wherein the movement cover defines an insertion hole and an avoidance slot;

the linkage shaft is provided with a clamping slot, and the linkage shaft is adapted to be inserted into the insertion hole;

the rotating shaft is provided with a connection portion, the connection portion is adapted to be clamped into the clamping slot through the avoidance slot, and the rotating shaft can drive the linkage shaft to synchronously rotate when the connection portion is clamped into the clamping slot;

the slide switch is mounted in the avoidance slot, the slide switch is slidably disposed between a first position and a second position, the slide switch exposes the clamping slot to allow the connection portion to be clamped into or detached from the clamping slot in the first position, and the slide switch covers the clamping slot to allow the connection portion to be kept in the clamping slot in the second position;

the protective cover is switchably disposed in a locked state and an unlocked state, in the unlocked state, the protective cover exposes the slide switch, in the locked state, the protective cover shields the slide switch, and the protective cover abuts against the slide switch to slide the slide switch from the first position to the second position; and the fixed sleeve is mounted in a cavity of the movement cover, the insertion hole and the avoidance slot are disposed in the fixed sleeve, an outer peripheral surface of the fixed sleeve is provided with a projection, the cavity is provided with a groove, and the projection is adapted to be matched with the groove to limit a mounting angle of the fixed sleeve.

* * * * *